US011168685B2

(12) United States Patent
Sun et al.

(10) Patent No.: US 11,168,685 B2
(45) Date of Patent: Nov. 9, 2021

(54) DUAL-VANE SCROLL COMPRESSOR WITH CAPACITY MODULATION

(71) Applicant: Emerson Climate Technologies (Suzhou) Co., Ltd., Jiangsu (CN)

(72) Inventors: Qingfeng Sun, Jiangsu (CN); Meng Wang, Jiangsu (CN)

(73) Assignee: Emerson Climate Technologies (Suzhou) Co., Ltd., Jiangsu (CN)

( * ) Notice: Subject to any disclaimer, the term of this patent is extended or adjusted under 35 U.S.C. 154(b) by 192 days.

(21) Appl. No.: 16/461,276

(22) PCT Filed: Oct. 27, 2017

(86) PCT No.: PCT/CN2017/107934
§ 371 (c)(1),
(2) Date: May 15, 2019

(87) PCT Pub. No.: WO2018/090809
PCT Pub. Date: May 24, 2018

(65) Prior Publication Data

US 2019/0277284 A1 Sep. 12, 2019

(30) Foreign Application Priority Data

Nov. 17, 2016 (CN) ..... 201611027570.5
Nov. 17, 2016 (CN) ..... 201621233439.X

(51) Int. Cl.
*F01C 1/02* (2006.01)
*F03C 2/00* (2006.01)
(Continued)

(52) U.S. Cl.
CPC ..... *F04C 18/0215* (2013.01); *F04C 18/02* (2013.01); *F04C 18/0284* (2013.01);
(Continued)

(58) Field of Classification Search
CPC ..... F04C 18/0215; F04C 18/0284; F04C 23/008; F04C 23/02; F04C 27/00;
(Continued)

(56) References Cited

U.S. PATENT DOCUMENTS 4,496,296 A * 1/1985 Arai ..... F04C 27/005 418/55.5
4,993,928 A 2/1991 Fraser, Jr.
(Continued)

FOREIGN PATENT DOCUMENTS

CN 103790831 A 5/2014
CN 203685570 U 7/2014
(Continued)

OTHER PUBLICATIONS

CN206175209 U—Sun et al.—Scroll Compressor—May 17, 2017—English Machine Translation of the Description (Year: 2017).*
(Continued)

*Primary Examiner* — Theresa Trieu
(74) *Attorney, Agent, or Firm* — Harness, Dickey & Pierce, P.L.C.

(57) ABSTRACT

Disclosed is a scroll compressor including stationary and movable scroll members engaged with each other. The stationary scroll member defines first and second air inlets and first and second air outlets. A first compression path is formed between the first air inlet outlet, and a second compression path is formed between the second air inlet outlet. The scroll compressor further includes a bypass passage for selectively communicating at least one of the first and second compression paths with a suction pressure area of the compressor. First and second back pressure cavities are formed on a side of the stationary scroll member facing away from the movable scroll member. The first back pressure cavity is in communication with the first compres-
(Continued)

sion path by means of a first back pressure passage. The second back pressure cavity is in communication with the second compression path by means of a second back pressure passage.

15 Claims, 5 Drawing Sheets

(51) Int. Cl.

| | |
|---|---|
| ***F03C 4/00*** | (2006.01) |
| ***F04C 2/00*** | (2006.01) |
| ***F04C 18/00*** | (2006.01) |
| ***F04C 18/02*** | (2006.01) |
| ***F04C 23/00*** | (2006.01) |
| ***F04C 27/00*** | (2006.01) |
| ***F04C 28/24*** | (2006.01) |
| ***F04C 23/02*** | (2006.01) |

(52) U.S. Cl.
CPC ..... *F04C 23/008* (2013.01); *F04C 23/02* (2013.01); *F04C 27/00* (2013.01); *F04C 27/005* (2013.01); *F04C 28/24* (2013.01); *F04C 2250/10* (2013.01); *F05B 2250/50* (2013.01)

(58) Field of Classification Search
CPC ..... F04C 27/005; F04C 28/24; F04C 28/26; F04C 29/12; F04C 2250/10; F05B 2250/50
See application file for complete search history.

(56) References Cited

U.S. PATENT DOCUMENTS

| | | | | |
|---|---|---|---|---|
| 5,340,292 | A * | 8/1994 | Steele | F04C 18/0215 418/55.1 |
| 5,451,146 | A * | 9/1995 | Inagaki | F04C 28/24 417/310 |
| 6,672,845 | B1 * | 1/2004 | Kim | F04C 28/24 417/310 |
| 9,097,253 | B2 | 8/2015 | Ginies et al. | |
| 2015/0330386 | A1 | 11/2015 | Doepker | |

FOREIGN PATENT DOCUMENTS

| | | | |
|---|---|---|---|
| CN | 204511880 | U | 7/2015 |
| CN | 205401109 | U | 7/2016 |
| CN | 205669486 | U | 11/2016 |
| CN | 206175209 | U | 5/2017 |
| JP | 2010038107 | A | 2/2010 |
| JP | 2010138749 | A | 6/2010 |

OTHER PUBLICATIONS

First Chinese Office Action regarding U.S. Appl. No. 16/461,276 dated Jan. 30, 2019. Google translation provided by Unitalen Attorneys at Law.
Extended European Search Report regarding Application No. 17870693.3 dated Jun. 12, 2020.
International Search Report for PCT/CN2017/107934 (in Chinese and English) and Written Opinion (in Chinese and English), dated Dec. 27, 2017; ISA/CN.

* cited by examiner

DUAL-VANE SCROLL COMPRESSOR WITH CAPACITY MODULATION

This application is the national phase of International Application No. PCT/CN2017/107934, titled "SCROLL COMPRESSOR" and filed on Oct. 27, 2017, which claims priority to Chinese Patent Application No. 201611027570.5 titled "SCROLL COMPRESSOR" and filed with the Chinese National Intellectual Property Administration on Nov. 17, 2016, and to Chinese Patent Application No. 201621233439.X titled "SCROLL COMPRESSOR" and filed with the Chinese National Intellectual Property Administration on Nov. 17, 2016. The entire disclosures of the two patent applications are incorporated herein by reference.

FIELD

The present application relates to a scroll compressor.

BACKGROUND

The contents of this section only provide background information related to the present disclosure and may not necessarily constitute the prior art.

In a scroll compressor, a non-orbiting scroll member and an orbiting scroll member each have end plates and spiral vanes, and the spiral vane of the non-orbiting scroll member is engaged with the spiral vane of the orbiting scroll member to form a series of compression pockets between the spiral vanes. As the orbiting scroll member orbits relative to the non-orbiting scroll member, the compression pockets are reduced in volume as they move from a suction port arranged at a radial outer side to a discharge port arranged at a radial inner side, thereby compressing working medium.

As for the scroll compressor in the conventional technology, in a case that there is an excessive clearance (vane-tip clearance) between a tip of the spiral vane of either scroll member and the end plate of the other scroll member, the excessive clearance leads to leakage loss of pressure in the compression pockets, thereby reducing efficiency. In order to avoid such case, a back pressure chamber has been applied in the conventional technology to press the non-orbiting scroll member and the orbiting scroll member together. Generally, the back pressure chamber is arranged on an upper side of the non-orbiting scroll member (facing away from the orbiting scroll member), and pressure in intermediate pressure compression pockets is introduced into the back pressure chamber through communication holes in the non-orbiting scroll member, thereby generating a back pressure on the non-orbiting scroll member directed toward the orbiting scroll member. The back pressure presses the orbiting scroll member and the non-orbiting scroll member together, resisting pressure in the compression pockets, so that there is an appropriate vane-tip load between the orbiting scroll member and the non-orbiting scroll member. When an abnormal working state occurs in the compression pockets, for example, a foreign matter or an incompressible liquid enters the compression pockets, the pressure in the compression pockets is overlarge, exceeding the back pressure, so that the non-orbiting scroll member is slightly moved away from the orbiting scroll member at this moment, and suction pressure communicates with discharge pressure through the vane-tip clearance, thereby releasing the overlarge pressure in the compression pockets to prevent damage to the scroll members.

However, as for a dual-vane scroll compressor, since the compressor has two spiral vanes, it is applicable to independently perform capacity modulation for the compression pockets corresponding to each spiral vane, at which time the total pressure of the compression pockets is reduced, whereas the back pressure is relatively large, causing excessive friction between the spiral vane-tips and the end plates of the two scroll members. The excessive friction causes wear of parts on the one hand, and reduces mechanical efficiency on the other hand.

SUMMARY

The inventors of the present application have realized the above problems and solved the above problems by a dual-vane scroll compressor according to the present application.

One object of the present application is to solve the problem of wear of parts caused by capacity modulation in the dual-vane scroll compressor.

According to the present application, a scroll compressor is provided, which includes a non-orbiting scroll member and an orbiting scroll member intermeshing with each other. The non-orbiting scroll member is provided with a first suction port, a second suction port, a first discharge port and a second discharge port. A first compression path is formed between the first suction port and the first discharge port, and a second compression path is formed between the second suction port and the second discharge port. The compressor further includes a bypass passage for communicating at least one of the first compression path and the second compression path with a suction pressure region of the compressor. The bypass passage is capable of selectively providing communication and disconnection. A first back pressure chamber and a second back pressure chamber are provided on a side of the non-orbiting scroll member facing away from the orbiting scroll member, where the first back pressure chamber communicates with the first compression path through a first back pressure passage, and the second back pressure chamber communicates with the second compression path through a second back pressure passage.

Optionally, projections of the first back pressure chamber and the second back pressure chamber onto the non-orbiting scroll member in an axial direction are in a shape of concentric rings.

Optionally, the non-orbiting scroll member is provided with an inner cylindrical portion, an intermediate cylindrical portion and an outer cylindrical portion. An inner space of the inner cylindrical portion communicates with the first discharge port and the second discharge port. The first back pressure chamber is defined between the inner cylindrical portion and the intermediate cylindrical portion, and the second back pressure chamber is defined between the intermediate cylindrical portion and the outer cylindrical portion.

Optionally, the compressor is provided with a partition plate. The partition plate divides the interior of a housing of the compressor into a suction pressure region on one side of the partition plate and a discharge pressure region on the other side of the partition plate. The non-orbiting scroll member together with the partition plate defines the first back pressure chamber and the second back pressure chamber on one side of the partition plate.

Optionally, a first sealing means is arranged in the first back pressure chamber, and a second sealing means is arranged in the second back pressure chamber. The first sealing means seals the first back pressure chamber relative to the second back pressure chamber, and the second sealing means seals the second back pressure chamber relative to the suction pressure region.

Optionally, a third sealing means is arranged in the inner space of the inner cylindrical portion, and the third sealing means seals the inner space relative to the first back pressure chamber.

Optionally, one or more of the first sealing means, the second sealing means and the third sealing means includes annular sealing members and supporters for supporting the annular sealing members.

Optionally, the first back pressure chamber and the second back pressure chamber are isolated from each other.

Optionally, the two spiral vanes of the orbiting scroll member respectively move in the first compression path and the second compression path. A first spiral vane of the orbiting scroll member arranged in the first compression path divides the first compression path into a first sub-path located on a radially outer side of the first spiral vane and a second sub-path located on a radially inner side of the first spiral vane. The first back pressure passage is in communication with only one of the first sub-path and the second sub-path. A second spiral vane of the orbiting scroll member arranged in the second compression path divides the second compression path into a third sub-path located on a radially outer side of the second spiral vane and a fourth sub-path located on a radially inner side of the second spiral vane. The second back pressure passage is in communication with only one of the third sub-path and the fourth sub-path.

Optionally, the compressor is a spiral-vane-symmetrical compressor, and a first opening of the first back pressure passage leading to the first compression path is arranged symmetrically with a first opening of the second back pressure passage leading to the second compression path.

Optionally, the non-orbiting scroll member has an integral structure, and the first back pressure passage, the second back pressure passage and the bypass passage are all arranged in the non-orbiting scroll member.

Optionally, the non-orbiting scroll member includes a non-orbiting scroll body portion and a cover plate which are detachably connected with each other. The first suction port, the second suction port, the first discharge port, and the second discharge port are formed in the non-orbiting scroll body portion, and the first back pressure chamber and the second back pressure chamber are partially defined by the cover plate.

Optionally, a first discharge chamber communicating with the first discharge port and a second discharge chamber communicating with the second discharge port are formed between the non-orbiting scroll body portion and the cover plate, and the bypass passage communicates at least one of the first compression path and the second compression path with the suction pressure region by communicating with at least one of the first discharge chamber and the second discharge chamber.

Optionally, the non-orbiting scroll body portion is provided herein with a plurality of capacity modulation passages communicating the first discharge chamber with the first compression path and a plurality of capacity modulation passages communicating the second discharge chamber with the second compression path. A check valve is arranged for each of the capacity modulation passages in the first discharge chamber and the second discharge chamber, and only allows the working medium to flow from the capacity modulation passage into the corresponding second discharge chamber.

Optionally, the first discharge chamber is isolated from the second discharge chamber.

In the present specification, "axial direction" means a direction in which a rotary shaft of the compressor extends, unless otherwise specified.

BRIEF DESCRIPTION OF DRAWINGS

Features and advantages of one or more embodiments of the present application will become easier to be understood through the following description in conjunction with the drawings. For the sake of clarity, the components in the drawings are not necessarily drawn to scale. In the drawings.

DETAILED DESCRIPTION OF EMBODIMENTS

Figure 1:
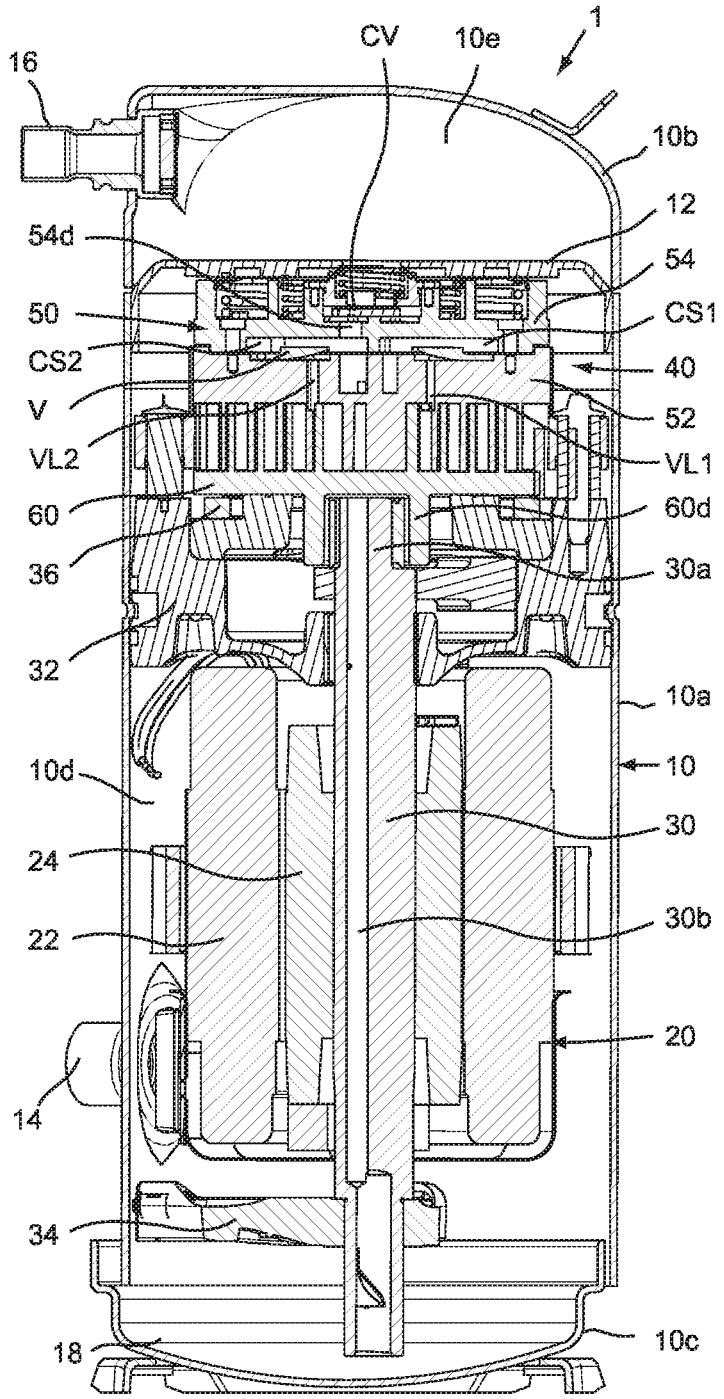
FIG. 1 is a longitudinal sectional view of a dual-vane scroll compressor according to the present application.

The following description of the preferred embodiments is merely exemplary and is by no means intended to limit the present application, its application or usage. The same reference numerals are used to designate like parts throughout the drawings, and the construction of the same parts will not be described repeatedly.

The inventors of the present application have realized the above problems and solved the above problems by designing the following compressor.

A dual-vane scroll compressor 1 according to an embodiment of the present application is described hereinafter with reference to FIG. 1. As shown in FIG. 1, the compressor 1 includes a substantially closed housing 10. The housing 10 may be constituted by a substantially cylindrical body portion 10*a*, a top cover 10*b* arranged at one end of the body portion 10*a*, and a bottom cover 10*c* arranged at the other end of the body portion 10*a*. A partition plate 12 is arranged between the top cover 10*b* and the body portion 10*a* to divide an internal space of the housing 10 into a suction pressure region 10*d* and a discharge pressure region 10*e*. The space between the partition plate 12 and the top cover 10*b* constitutes the discharge pressure region 10*e*, and the space formed by the partition plate 12, the body portion 10*a* and the bottom cover 10*c* constitutes the suction pressure region 10*d*. A suction joint 14 for sucking the working medium is arranged in the suction pressure region 10*d*, and a discharge joint 16 for discharging the compressed working medium is arranged in the discharge pressure region 10*e*.

A drive mechanism 20 and a compression mechanism 40 driven by the drive mechanism 20 to compress the working medium (such as a refrigerant) are received in the housing 10. In the present embodiment, the scroll compressor 1 is of a low-pressure-side design, that is, the drive mechanism 20 and the compression mechanism 40 are both in the suction pressure region 10*d*.

The drive mechanism 20 may be, for example, a motor composed of a stator 22 and a rotor 24. The stator 22 may be fixed relative to the housing 10 in any suitable manner. The rotor 24 is rotatable in the stator 22 and is provided with a drive shaft 30 therein. An upper end of the drive shaft 30 is supported by a main bearing housing 32 through a main bearing; and a lower end thereof is supported by a lower bearing housing 34 through a lower bearing. Both the main bearing housing 32 and the lower bearing housing 34 are fixedly connected to the body portion 10*a* of the housing 10. An eccentric crank pin 30*a* is formed at one end of the drive shaft 30. The eccentric crank pin 30*a* is fitted into a hub 60*d* of an orbiting scroll member 60 (described below) to drive the compression mechanism 40. A lubricating oil passage 30*b* is further provided in the drive shaft 30 to supply lubricating oil from an oil pool 18 located at a lower portion of the housing 10 to the main bearing and the compression mechanism 40.

The compression mechanism 40 may include a non-orbiting scroll member 50 and the orbiting scroll member 60. The non-orbiting scroll member 50 may be fixed relative to the housing 10 in any suitable manner, for example, fixed by bolts relative to the main bearing housing 32. Driven by the rotary shaft 30, the orbiting scroll member 60 can orbit relative to the non-orbiting scroll member 50 (i.e., a central axis of the orbiting scroll member 60 rotates around a central axis of the non-orbiting scroll member 50, but the orbiting scroll member 60 itself does not rotates about its own central axis) to achieve compression of the working medium. The orbiting movement is realized by an Oldham coupling 36 provided between the orbiting scroll member 60 and the main bearing housing 32. Alternatively, the Oldham coupling may be provided between the non-orbiting scroll member 50 and the orbiting scroll member 60.

Figure 2:
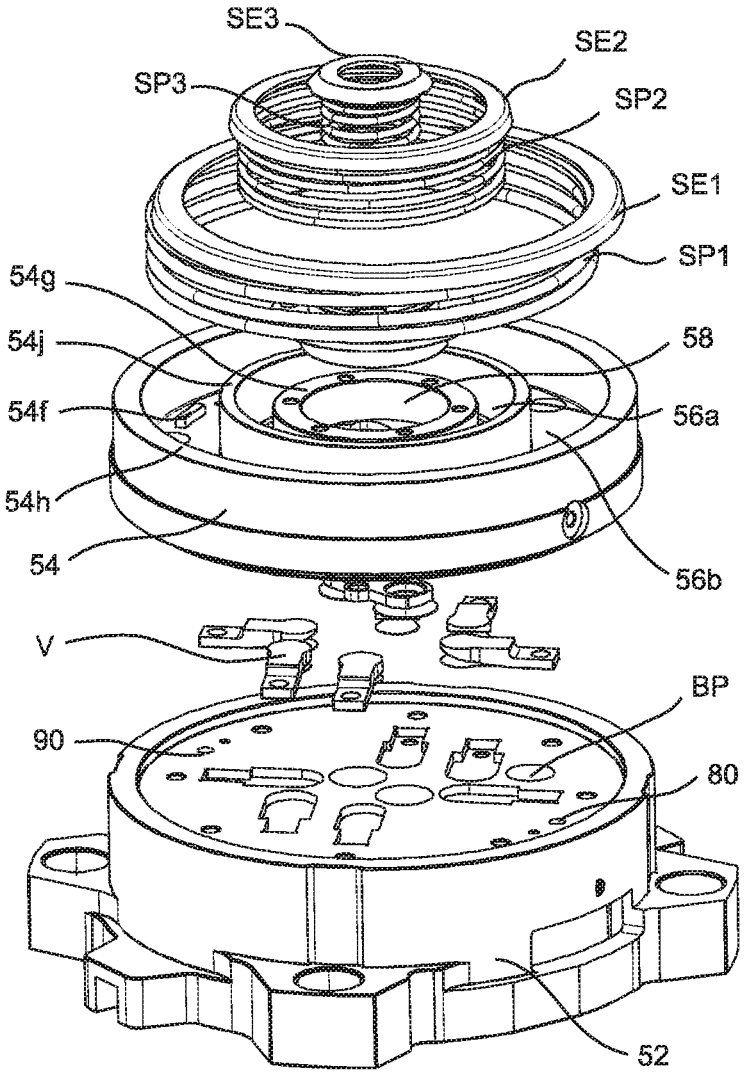
FIG. 2 is a perspective exploded view of a non-orbiting scroll member.
Figure 3:
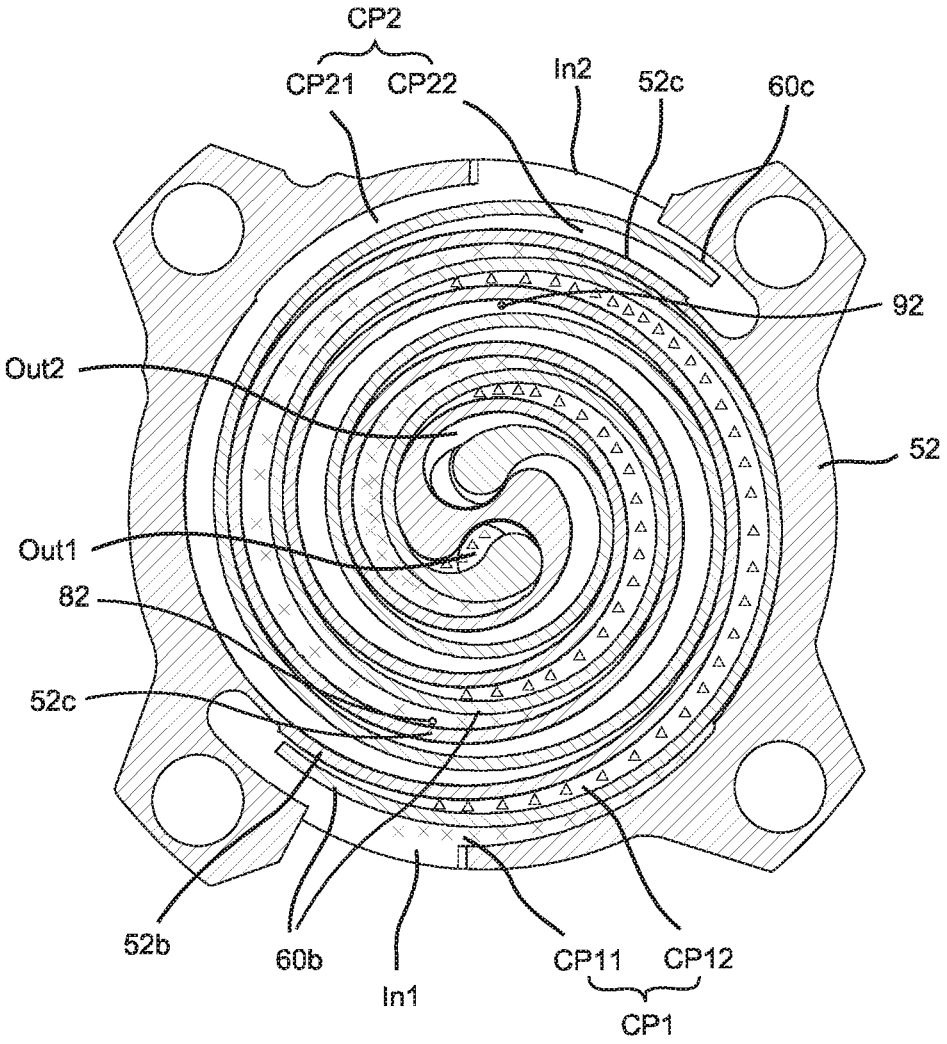
FIG. 3 is a cross sectional view of the non-orbiting scroll member and an orbiting scroll member seeing from the bottom.
Figure 4:
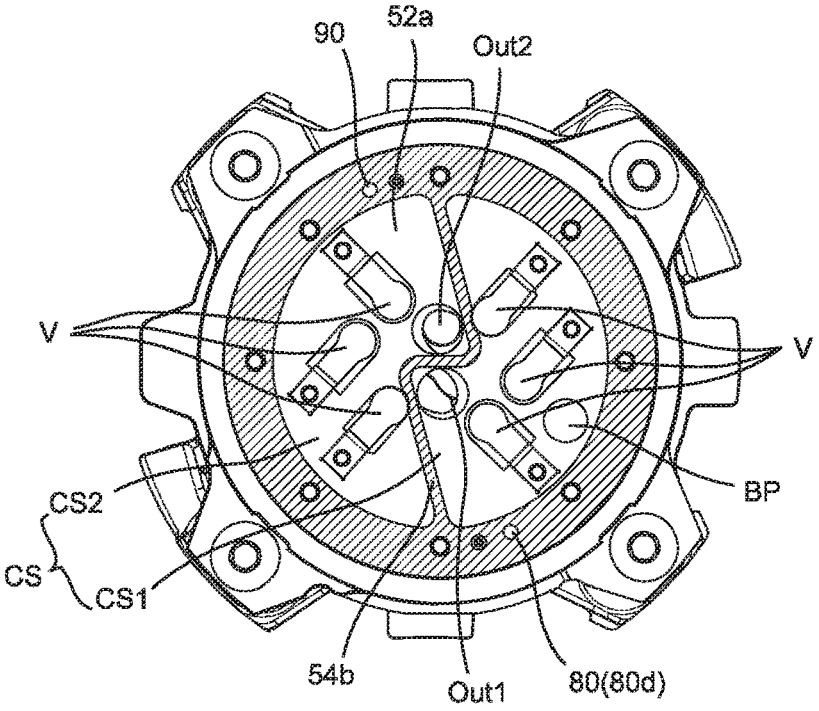
FIG. 4 is a cross sectional view of the non-orbiting scroll member taken at a discharge chamber seeing from the top.
Figure 7:
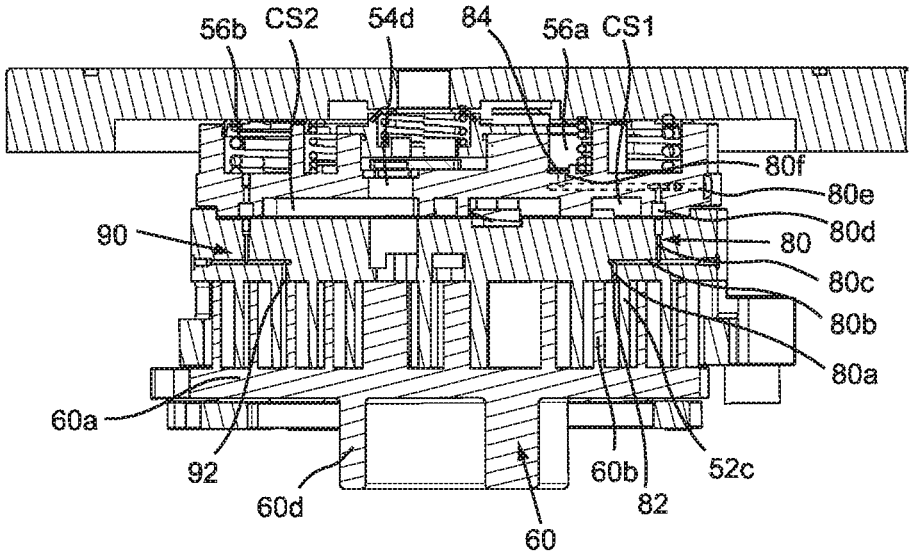
FIG. 7 is a longitudinal sectional view of the non-orbiting scroll member and the orbiting scroll member taken at the two back pressure passages.

As shown in FIG. 2, the non-orbiting scroll member 50 has a split structure, and includes a non-orbiting scroll body portion 52 and a cover plate 54 which are fixed to each other by, for example, bolts (not shown). With reference to FIG. 3, a first suction port In1 and a second suction port In2 are formed in the periphery of the non-orbiting scroll body portion 52 at substantially radial opposing positions. For other scroll designs, the first suction port In1 and the second suction port In2 may be in other positions, or may be combined into one suction port. With reference to FIGS. 3 and 4, the non-orbiting scroll body portion 52 includes an end plate 52*a*, and a first discharge port Out1 and a second discharge port Out2 are formed at a substantially radial central portion of the end plate 52*a*. The working medium entering via the first suction port In1 is discharged via the first discharge port Out1, and the working medium entering via the second suction port In2 is discharged via the second discharge port Out2. Therefore, a passage between the first suction port In1 and the first discharge port Out1 is referred to as a first compression path CP1, and a passage between the second suction port In2 and the second discharge port Out2 is referred to as a second compression path CP2. The first compression path CP1 is isolated from the second compression path CP2 by the spiral vanes of the non-orbiting scroll (described below). The non-orbiting scroll body portion 52 includes two spiral vanes formed on a lower side of the non-orbiting scroll end plate 52*a* (on a side toward the orbiting scroll member 60), that is, a first non-orbiting scroll spiral vane 52*b* and a second non-orbiting scroll spiral vane 52*c*, which extend axially from the end plate 52*a*. With reference to FIGS. 3 and 7, the orbiting scroll member 60 may include: an orbiting scroll end plate 60*a*; two spiral vanes, that is, a first orbiting scroll spiral vane 60*b* and a second orbiting scroll spiral vane 60*c*, extending axially from an upper side of the orbiting scroll end plate 60*a* (i.e., from a side facing the non-orbiting scroll member 50); and the hub 60*d* extending axially from a lower side of the orbiting scroll end plate 60*a*. The two spiral vanes 52*b*, 52*c* of the non-orbiting scroll member 50 are engaged with the two spiral vanes 60*b*, 60*c* of the orbiting scroll member. Specifically, the first compression path CP1 between the first suction port In1 and the first discharge port Out1 is partitioned by the first orbiting scroll spiral vane 60*b* into two sub-paths not communicating with each other on a radially outer side and a radially inner side thereof, that is, a first sub-path CP11 located on the radially outer side (see the path indicated by the crosses in FIG. 3) and a second sub-path CP12 located on the radially inner side (see the path indicated by the triangles in FIG. 3). Similarly, the second compression path CP2 between the second suction port In2 and the second discharge port Out2 is partitioned by the second orbiting scroll spiral vane 60*c* into two sub-paths not communicating with each other on a radially outer side and a radially inner side thereof, that is, a third sub-path CP21 and a fourth sub-path CP22 (for the sake of clarity, they are not indicated with any symbols in the drawings). In each of the sub-paths, the spiral vanes, the non-orbiting scroll end plate 52*a* and the orbiting scroll end plate 60*a* together form a series of closed compression pockets. As the orbiting scroll member 60 orbits, these compression pockets continuously move from the radially outer side to the radially inner side and are reduced in volume to gradually increase the pressure of the working medium.

Figure 6:
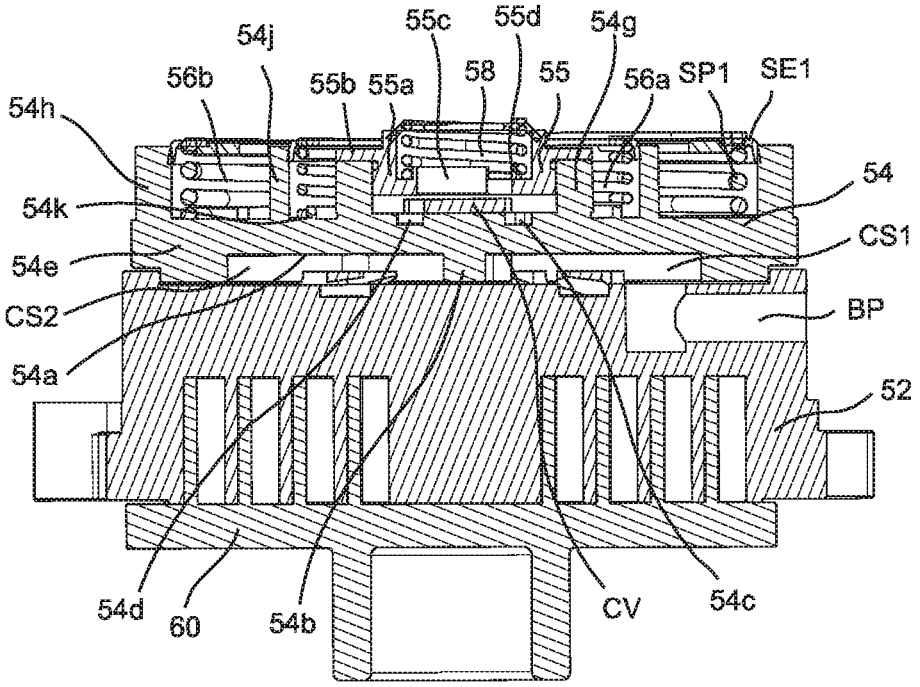
FIG. 6 is a longitudinal sectional view of the non-orbiting scroll member and the orbiting scroll member taken at the bypass passage.

In conjunction with FIGS. 4 and 6, a substantially circular discharge space CS is provided between the cover plate 54 and the non-orbiting scroll body portion 52. The discharge space CS in the illustrated embodiment is formed by a recess 54*a* located on a lower side of the cover plate 54. However, it can be anticipated that the discharge space CS may be formed by a recess located on an upper side of the non-orbiting scroll body portion 52, or may be formed by both the cover plate 54 and the non-orbiting scroll body portion 52. A partition 54*b* is formed in the recess 54*a*, and extends downward from the cover plate 54. It can be anticipated that the partition 54*b* may extend from the non-orbiting scroll body portion 52 or be formed by both the cover plate 54 and the non-orbiting scroll body portion 52. As shown in FIG. 4, the partition 54*b* passes between the first discharge port Out1 and the second discharge port Out2 on the non-orbiting scroll end plate 52*a*, thereby partitioning the discharge space CS into a first discharge chamber CS1 in communication with the first discharge port Out1 on the non-orbiting scroll end plate 52*a* and a second discharge chamber CS2 in communication with the second discharge port Out2 on the non-orbiting scroll end plate 52*a*. In addition, referring to FIGS. 1 and 6, a first discharge hole 54*c* (not shown in FIG. 1 but shown partially in FIG. 6 due to the cutaway position,) communicating with the first discharge chamber CS1 and a second discharge hole 54*d* communicating with the second discharge chamber CS2 are correspondingly arranged at substantially central positions of the cover plate 54. Two check valves CV (only one check valve CV communicating with the second discharge hole 54*d* is shown) are arranged outside the first discharge hole and the second discharge hole 54*d*, respectively, to set discharge pressures of the two discharge holes to a system pressure P (i.e., an inlet pressure P of a condenser of a system provided with the compressor 1) outside the check valves CV, such that highest pressures of the first discharge chamber CS1 and the second discharge chamber CS2 are determined by the system pressure P outside the check valves CV. The person skilled in the art can appreciate that the above check valves CV arranged on the cover plate 54 may be omitted, while check valves for controlling discharge may be arranged at the first discharge port Out1 and the second discharge port Out2 on the non-orbiting scroll end plate 52*a*.

In each of the first discharge chamber CS1 and the second discharge chamber CS2, three check valves V are respectively arranged on the non-orbiting scroll body portion 52, and a capacity modulation passage VL is correspondingly arranged beneath each of the check valves V, and leads to the corresponding compression path CP1 or CP2. Specifically, the capacity modulation passages VL corresponding to the check valves V in the first discharge chamber CS1 leads to the first compression path, and the capacity modulation passages VL corresponding to the check valves V in the second discharge chamber CS2 leads to the second compression path. And, these capacity modulation passages VL respectively lead to compression pockets at different pressures. FIG. 1 shows some capacity modulation passages VL1, VL2. It can be anticipated that the check valves V and the capacity modulation passages VL may be provided in different numbers and at different positions to selectively communicate with the compression pockets at different pressures. The check valve V can be opened unidirectionally upward when the pressure in the corresponding compression pocket is larger than the pressure above the check valve V (the pressure in the first discharge chamber CS1 or the second discharge chamber CS2). The check valve V is closed, when the pressure above the check valve V is larger than the pressure in the corresponding compression pocket. That is, the check valve V only allows the working medium to flow unidirectionally from the compression path into the corresponding discharge chamber.

The check valve V is provided to realize variable volume ratio (VVR). Generally, when the scroll compression mechanism is determined, the compression ratio that the scroll compression mechanism can provide is basically determined. On the one hand, in a case that the compressor 1 can provide a compression ratio (i.e., a large discharge pressure) large than a compression ratio required by the system (i.e., a small system pressure P), if the working medium is completely compressed by the compression mechanism 40 and discharged through the first discharge port Out1 and the second discharge port Out2, it will be excessively compressed and then partially expand, causing power loss. However, in a case that the check valves V are provided, when the working medium is halfway compressed, the pressure of the compression pocket corresponding to one or more check valves V have reached the discharge requirement, that is, have reached the system pressure P. Then, the corresponding check valve(s) V and the above-mentioned check valve CV can be opened, and the working medium can be discharged in advance without being excessively compressed. On the other hand, in a case that the compressor can provide a compression ratio smaller than a compression ratio required by the system, the pressure at the first discharge port Out1 and the second discharge port Out2 may be smaller than the system pressure P and cannot open the check valve CV on the cover plate 54. Then, the pressure accumulates in the first discharge chamber CS1 and the second discharge chamber CS2, and the check valve CV remains closed. The compression mechanism 40 continues to compress more working medium, until the pressure in the first discharge chamber CS1 and the second discharge chamber CS2 exceeds the system pressure P outside the check valve CV, whereby different discharge pressures can be provided in a self-adaptive manner by the same compression mechanism 40.

Figure 5:
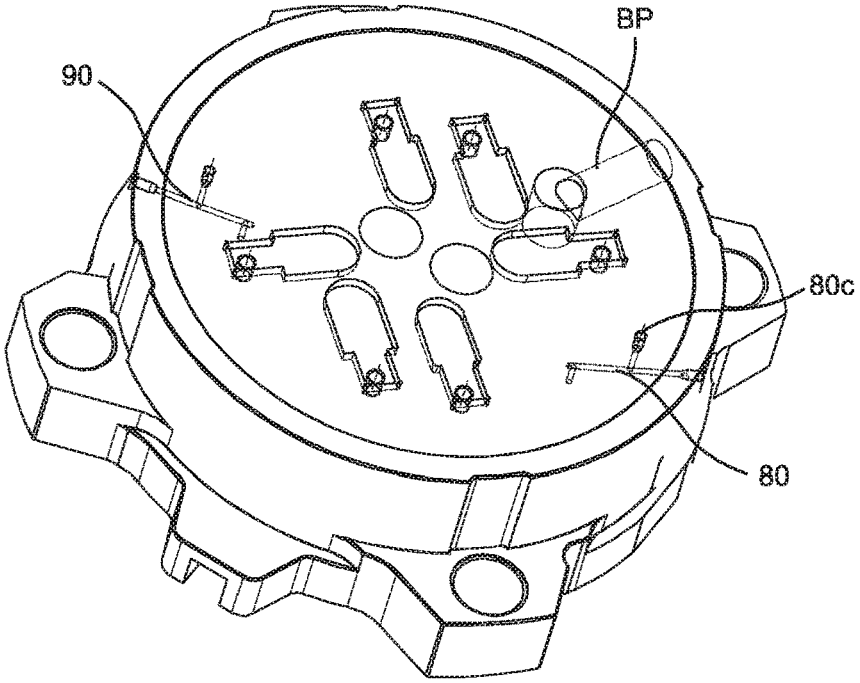
FIG. 5 is a perspective view of a non-orbiting scroll body portion, in which the bypass passage and the back pressure passage in the non-orbiting scroll body portion are illustrated by dashed lines.

In addition, referring to FIGS. 5 and 6, a bypass passage BP is further arranged in the non-orbiting scroll end plate 52*a*, and the bypass passage BP can selectively communicate the first discharge chamber CS1 with the suction pressure region 10*d*, causing the pressure in the first discharge chamber CS1 (and the pressure in the first compression path CP1) to be reduced to the suction pressure. For example, the open/close of the bypass passage BP can be controlled by a solenoid valve (not shown).

The bypass passage BP can be provided to realize capacity modulation. The bypass passage BP is cut off when the compressor is in a normal working state. When the bypass passage BP is opened, the pressure of the first discharge chamber CS1 becomes an external lower pressure, that is, the suction pressure. Since the pressure of the first discharge chamber CS1 is lowered, all the check valves V for the first discharge chamber CS1 are opened, and the pressure in the first compression path CP1 (including the first sub-path CP11 and the second sub-path CP12 thereof) communicating with the first discharge chamber CS1 is released in a short time, becoming the suction pressure. As such, the working medium can be compressed only by the second compression path CP2 (including the first sub-path CP21 and second sub-path CP22 thereof), and the volume of the compressor becomes half of that in the normal working state. By controlling, for example, the on-off time of the bypass passage BP, it is possible to achieve, for example, a capacity modulation from 500 to 100%. It is also conceivable to realize a capacity modulation from 0% to 100% by providing another bypass passage and a corresponding control valve for the second discharge chamber CS2.

Though the above-mentioned compressor capacity change between 50% and 100% is described with respect to a compressor having symmetrical spiral vanes (the spiral vanes have profiles of the same length and symmetrical shapes), it can be anticipated that a compressor with two asymmetrical spiral vanes (for example, spiral vanes of different heights or lengths) may otherwise modulate the volume ratio, for example, between 70% and 100%. Moreover, in such an asymmetric compressor, bypass passages may be respectively provided for the first discharge chamber CS1 and the second discharge chamber CS2 to realize more volume ratios, for example, between 70, (bypassing the first discharge chamber CS1), 30% (bypassing the second discharge chamber CS2) and 100% (no bypassing).

As shown in FIGS. 1, 2 and 6, two back pressure chambers are defined on the upper side (i.e., the side facing away from the orbiting scroll member 60) of the cover plate 54 of the non-orbiting scroll member 50, that is, a first back pressure chamber 56*a* and a second back pressure chamber 56*b*. The cover plate 54 includes: a base 54*e*, in which the recess 54*a*, the first discharge hole 54*c* and the second discharge hole 54*d* are provided; an inner cylindrical portion 54*g* extending upwardly from the base 54*e* and surrounding the first discharge hole 54*c* and the second discharge hole 54*d* on the base 54*e*, that is, the first discharge hole 54*c* and the second discharge hole 54*d* being located radially inside the inner cylindrical portion 54*g*, whereby an inner space of the inner cylindrical portion 54*g* is at the system pressure P; an outer cylindrical portion 54*h* extending from the periphery of the base 54*e* and arranged concentrically with the inner cylindrical portion 54*g*; and an intermediate cylindrical portion 54*j* arranged between the inner cylindrical portion 54*g* and the outer cylindrical portion 54*h*. A first back pressure chamber 56*a* is defined between the inner cylindrical portion 54*g* and the intermediate cylindrical portion 54*j*, and a second back pressure chamber 56*b* is defined between the intermediate cylindrical portion 54*j* and the outer cylindrical portion 54*h*. Therefore, axial projections of the first back pressure chamber 56*a* and the second back pressure chamber 56*b* on the non-orbiting scroll member 50 are in the form of concentric rings, thereby providing a uniform back pressure in a circumferential direction and preventing the non-orbiting scroll member 50 from tilting.

The slight disengagement of the non-orbiting scroll member and the orbiting scroll member is realized by slight axial movement of the non-orbiting scroll member, that is, the non-orbiting scroll member can "float". In order to provide a seal in the case of the "floating" non-orbiting scroll member, sealing means are provided at an upper end of each of the cylindrical portions, for example, a floating sealing means including an annular sealing member and a coil spring (depending on the various designs, the coil spring may take other forms, such as a spring bracket). Specifically, an annular sealing member SE1 is provided on the inner side of the upper end of the outer cylindrical portion 54*h*, and has an L-shaped cross section. The annular sealing member SE1 is axially supported by a coil spring SP1 accommodated in the second back pressure chamber 56*b*, such that two legs of L-shape abut against the partition plate 12 (the partition plate 12 is not shown in FIGS. 2 and 6, but shown in FIG. 1) and the outer cylindrical portion 54*h* respectively, thereby providing a floating seal between the partition plate 12 and the outer cylindrical portion 54*h*, that is, sealing the second back pressure chamber 56*b* relative to the suction pressure region 10*d*. A plurality of stopping portions 54*f* (see FIG. 2) may be provided in the circumferential direction on an upper surface of the base 54*e* of the cover plate 54 for restraining the coil spring SP1 from a radial inner portion of the coil spring SP1. A similar floating sealing means is also provided inside the intermediate cylindrical portion 54*j*, and includes an annular sealing member SE2 and a coil spring SP2. Besides, stopping portions 54*k* for restraining the coil spring SP2 may be provided on the base 54*e*, and the floating sealing means seals the first back pressure chamber 56*a* relative to the second back pressure chamber 56*b*.

In the embodiment shown in the drawings, a bracket 55 is fixedly arranged on the inner cylindrical portion 54*g*, and has an axially extending cylindrical portion 55*a* having a bottom and a flange portion 55*b* radially extending outward from an outer surface of the cylindrical portion 55*a*. The outer surface of the cylindrical portion 55*a* abuts against an inner surface of the inner cylindrical portion 54*g*, and the flange portion 55*b* presses against an upper end surface of the inner cylindrical portion 54*g* and fixed to the inner cylindrical portion 54*g* by bolts or the like. An opening 55*c* is provided in a bottom surface of the cylindrical portion 55*a* to discharge the working medium coming from the discharge holes 54*c*, 54*d*. A chamber enclosed by the inner cylindrical portion 54*g* of the cover plate 54 and the cylindrical portion 55*a* of the bracket 55 is referred to as a discharge chamber 58 hereinafter.

A similar floating sealing means is also provided in the cylindrical portion 55*a* of the bracket 55, and includes an annular sealing member SE3 and a coil spring SP3, thereby realizing a floating seal between the bracket 55 and the partition plate 12, that is, sealing the inner space of the inner cylindrical portion 54*g* relative to the first back pressure chamber 56*a*. Besides, a stopping portion 55*d* may be arranged at a bottom of the bracket 55 for restraining the coil spring SP3. It can be understood that such arrangement is to avoid interference between the check valve CV and the coil spring SP3 and to facilitate arrangement of the stopping portion 55*d*. The bracket 55 may be integrally formed with the inner cylindrical portion 54*g* of the cover plate 54 if the space permits, that is, the floating sealing means including the annular sealing member SE3 and the coil spring SP3 may realize a seal between the inner cylindrical portion 54*g* of the cover plate 54 and the partition plate 12.

Referring to FIGS. 5 and 7, in order to generate a back pressure in the first back pressure chamber 56*a* and the second back pressure chamber 56*b*, a first back pressure passage 80 and a second back pressure passage 90 are provided in the non-orbiting scroll member 50. Specifically, the first back pressure passage 80 communicates the first compression path CP1 with the first back pressure chamber 56*a*, and the second back pressure passage 90 communicates the second compression path CP2 with the second back pressure chamber 56*b*. The following detailed description will be given by taking only the first back pressure passage 80 as an example.

In the embodiment shown in the drawings, the first back pressure passage 80 communicates the first compression path CP1 with the first back pressure chamber 56*a*, specifically, communicates the first sub-path CP11 (located between the second non-orbiting scroll spiral vane 52*c* and the first orbiting scroll spiral vane 60*b*) of the first compression path CP1 with the first back pressure chamber 56*a*. A first opening 82 on the non-orbiting scroll end plate 52*a* is arranged in close proximity to the second non-orbiting scroll spiral vane 52*c*, such that during the movement of the first orbiting scroll spiral vane 60*b*, the first opening 82 is either on a radial outer side of the first orbiting scroll spiral vane 60*b* or is covered by the first orbiting scroll spiral vane 60*b*. In other words, a size of the first opening 82 is smaller than a thickness of the first orbiting scroll spiral vane 60*b*, so that the first orbiting scroll spiral vane 60*b* can at most cover the first opening 82 rather than moving across the first opening 82. Therefore, it can be ensured that the first opening 82 is always in communication only with the first sub-path CP11 of the first compression path CP1, and will not become to communicate with the second sub-path CP12 on the radial inner side of the first orbiting scroll spiral vane 60*b* as the first orbiting scroll spiral vane 60*b* moves, so as to prevent the first compression path CP1 from communicating with the second compression path CP2 through the first opening 82 and avoid pressure leakage and power loss.

Obviously, the first opening 82 may be in communication only with the second sub-path CP12 of the first compression path CP1, which will not be described herein again.

The first back pressure passage 80 includes a series of radial passages and axial passages in the base 54*e* of the cover plate 54 and the non-orbiting scroll end plate 52*a*, such as an axial passage 80*a* including the first opening 82, a radial passage 80*b* and an axial passage 80*c* (an end portion thereof is shown in FIG. 5) which are located in the non-orbiting scroll end plate 52*a*, and an axial passage 80*d* (a section thereof is shown in FIG. 4), a radial passage 80*e* and an axial passage 80*f* with a second opening 84 leading to the back pressure chamber 56*a* which are located in the cover plate 54. The radial passage 80*b* is for connecting the axial passages 80*a* and 80*c* at different radial positions, and the radial passage 80*e* is for connecting the axial passages 80*d* and 80*f* at different radial positions. And, the radial outer ends of the radial passages may be blocked. It can be understood that these radial passages and axial passages are only provided for introducing the pressure in the second sub-path CP12 of the first compression path CP1 into the back pressure chamber 56*a*. For this purpose, passages with different orientations may be included or may be provided in different parts as well.

In a similar manner, the second back pressure passage 90 communicates with the second compression path CP2 at a first opening 92 such that the corresponding sub-path communicates with the second back pressure chamber 56*b*. Specifically, in the illustrated embodiment, the first opening 92 of the second back pressure passage 90 leads to the fourth sub-path CP22 (defined by the first non-orbiting scroll spiral vane 52*b* and the second orbiting scroll spiral vane 60*c*) of the second compression path CP2 located on a radially outer side of the second orbing scroll spiral vane 60*c*. Obviously, the second back pressure passage 90 may lead to the third sub-path CP21.

Therefore, the pressures in the first back pressure chamber 56*a* and the second back pressure chamber 56*b* press the non-orbiting scroll member 50 and the orbiting scroll member 60 together, so that there is an appropriate vane-tip load therebetween.

In a case that the bypass passage BP is opened, as described above, the pressure in the first compression path CP1 communicating with the first discharge chamber CS1 is released in a short time and becomes the suction pressure. Therefore, the pressure at the first opening 82 of the first back pressure passage 80 also becomes the suction pressure, and the back pressure in the first back pressure chamber 56*a* is also released to become the suction pressure through the first back pressure passage 80 and no longer functions. In such case only the second back pressure chamber 56*b* continues to provide the back pressure which is adapted to the reduced capacity of the compressor, thereby pressing together the non-orbiting scroll member 50 and the orbiting scroll member 60 with an appropriate force, maintaining an appropriate vane-tip load, and preventing wear of the parts.

The back pressure that the back pressure chamber can provide may be varied by changing effective areas (i.e., the axial projection areas of the back pressure chambers on the non-orbiting scroll member 50) of the two back pressure chambers 56*a* and 56*b* or by changing positions of the first opening 82 of the first back pressure passage 80 and the first opening 92 of the second back pressure passage 90.

For a spiral-vane-symmetrical compressor, the first opening 82 of the first back pressure passage 80 and the first opening 92 of the second back pressure passage 90 may be arranged at symmetrical positions. However, the area of the first back pressure chamber 56*a* is not necessarily equal to that of the second back pressure chamber 56*b*. In view of factors such as forces provided by the coil springs SP1 to SP3, the gravity of the non-orbiting scroll member 50 and the like, a force that the back pressure chamber is required to provide after the bypass passage BP is opened may not be equal to half of a force required when the bypass passage BP is not opened. Alternatively, the first opening 82 of the first back pressure passage 80 and the first opening 92 of the second back pressure passage 90 may be arranged at asymmetrical positions, such that each of the back pressure chambers 56*a* and 56*b* can provide a corresponding back pressure when a corresponding compression path works alone. In this way, the back pressure passage corresponding to the working compression path can provide an appropriate back pressure, whether the first discharge port Out1 or the second discharge port Out2 is bypassed.

For the spiral-vane-asymmetrical compressor, the two back pressure chambers can provide the corresponding back pressure when the corresponding compression path works alone by designing the areas of the two back pressure chambers and the positions of the first openings of the two back pressure passages.

It can be understood that a split structure of the non-orbiting scroll member 50 composed of the non-orbiting scroll body portion 52 and the cover plate 54 is only for convenient arrangement of the check valves V. However, an integral non-orbiting scroll member may be adopted in a case of using other types of check valves or in a case of no check valves V and no capacity modulation passages VL. In this case, the described features of the non-orbiting scroll body portion 52 and the cover plate 54 in the above embodiment should be understood as being directly arranged on the integral non-orbiting scroll member. For example, the first back pressure chamber and the second back pressure chamber are formed on the upper side of the non-orbiting scroll member, the bypass passage BP and the back pressure passages 80 and 90 are all arranged in the non-orbiting scroll member.

While the various embodiments of the present application have been described in detail herein, it is to be appreciated that the present application is not limited to the specific embodiments described and illustrated herein in detail, and other variations and modifications can be implemented by the person skilled in the art without departing from the essence and scope of the present application. All the variations and modifications are within the scope of the present application. Moreover, all of the components described herein can be replaced by other technically equivalent components.

The invention claimed is:

1. A scroll compressor comprising a non-orbiting scroll member and an orbiting scroll member intermeshing with each other, the non-orbiting scroll member being provided with a first suction port, a second suction port, a first discharge port and a second discharge port, a first compression path being formed between the first suction port and the first discharge port, and a second compression path being formed between the second suction port and the second discharge port, wherein the compressor further comprises a bypass passage for selectively communicating at least one of the first compression path and the second compression path with a suction pressure region of the compressor, and a first back pressure chamber and a second back pressure chamber are formed on a side of the non-orbiting scroll member facing away from the orbiting scroll member, wherein the first back pressure chamber communicates with the first compression path through a first back pressure passage, and the second back pressure chamber communicates with the second compression path through a second back pressure passage.

2. The compressor according to claim 1, wherein projections of the first back pressure chamber and the second back pressure chamber onto the non-orbiting scroll member in an axial direction are in a shape of concentric rings.

3. The compressor according to claim 1, wherein the non-orbiting scroll member is formed with an inner cylindrical portion, an intermediate cylindrical portion and an outer cylindrical portion, an inner space of the inner cylindrical portion communicates with the first discharge port and the second discharge port, the first back pressure chamber is defined between the inner cylindrical portion and the intermediate cylindrical portion, and the second back pressure chamber is defined between the intermediate cylindrical portion and the outer cylindrical portion.

4. The compressor according to claim 3, wherein the compressor is provided with a partition plate, the partition plate is adapted to divide the interior of a housing of the compressor into the suction pressure region on one side of the partition plate and a discharge pressure region on the other side of the partition plate, and the non-orbiting scroll member together with the partition plate defines the first back pressure chamber and the second back pressure chamber on said one side of the partition plate.

5. The compressor according to claim 4, wherein a first seal is arranged in the first back pressure chamber, a second seal is arranged in the second back pressure chamber, the first seal is adapted to seal the first back pressure chamber relative to the second back pressure chamber, and the second seal is adapted to seal the second back pressure chamber relative to the suction pressure region.

6. The compressor according to claim 5, wherein a third seal is arranged in the inner space of the inner cylindrical portion, and the third seal is adapted to seal the inner space relative to the first back pressure chamber.

7. The compressor according to claim 6, wherein one or more of the first seal, the second seal and the third seal comprise annular sealing members and supporters for supporting the annular sealing members.

8. The compressor according to claim 1, wherein the first back pressure chamber and the second back pressure chamber are isolated from each other.

9. The compressor according to claim 1, wherein two spiral vanes of the orbiting scroll member respectively move in the first compression path and the second compression path, a first spiral vane of the orbiting scroll member arranged in the first compression path is adapted to divide the first compression path into a first sub-path located on a radially outer side of the first spiral vane and a second sub-path located on a radially inner side of the first spiral vane, and the first back pressure passage is in communication with one of the first sub-path and the second sub-path; and a second spiral vane of the orbiting scroll member arranged in the second compression path is adapted to divide the second compression path into a third sub-path located on a radially outer side of the second spiral vane and a fourth sub-path located on a radially inner side of the second spiral vane, and the second back pressure passage is in communication with one of the third sub-path and the fourth sub-path.

10. The compressor according to claim 1, wherein the spiral vanes of the compress are symmetrical, the first back pressure passage has a first opening leading to the first compression path, and the second back pressure passage has a first opening leading to the second compression path and arranged symmetrically with the first opening of the first back pressure passage.

11. The compressor according to claim 1, wherein the non-orbiting scroll member has an integral structure, and the first back pressure passage, the second back pressure passage and the bypass passage are all arranged in the non-orbiting scroll member.

12. The compressor according to claim 1, wherein the non-orbiting scroll member includes a non-orbiting scroll body portion and a cover plate which are detachably connected with each other, wherein the first suction port, the second suction port, the first discharge port, and the second discharge port are formed in the non-orbiting scroll body portion, and wherein the first back pressure chamber and the second back pressure chamber are partially defined by the cover plate.

13. The compressor according to claim 12, wherein a first discharge chamber communicating with the first discharge port and a second discharge chamber communicating with the second discharge port are formed between the non-orbiting scroll body portion and the cover plate, and the bypass passage communicates at least one of the first compression path and the second compression path with the suction pressure region by communicating with at least one of the first discharge chamber and the second discharge chamber.

14. The compressor according to claim 13, wherein the non-orbiting scroll body portion is provided therein with a plurality of capacity modulation passages for communicating the first discharge chamber with the first compression path and a plurality of capacity modulation passages for communicating the second discharge chamber with the second compression path, a check valve is arranged for each of the capacity modulation passages in the first discharge chamber and the second discharge chamber, such as to only allow a working medium to flow from the capacity modulation passage into the corresponding discharge chamber.

15. The compressor according to claim 13, wherein the first discharge chamber and the second discharge chamber are isolated from each other.

* * * * *